United States Patent [19]

Lawes et al.

[11] 4,302,429

[45] Nov. 24, 1981

[54] PROCESS FOR SOLUTION MINING OF URANIUM ORES

[75] Inventors: Bernard C. Lawes; John C. Watts, both of Wilmington, Del.

[73] Assignee: E. I. Du Pont de Nemours and Company, Wilmington, Del.

[21] Appl. No.: 15,207

[22] Filed: Feb. 26, 1979

Related U.S. Application Data

[63] Continuation-in-part of Ser. No. 739,968, Nov. 8, 1976, abandoned.

[51] Int. Cl.[3] ..... C01G 43/00; E21B 43/28

[52] U.S. Cl. ..... 423/17; 299/5

[58] Field of Search ..... 299/4, 5; 423/17, 15; 252/186

[56] References Cited

U.S. PATENT DOCUMENTS

| | | | |
|---|---|---|---|
| 3,687,627 | 8/1972 | Stalter | 252/186 |
| 3,740,187 | 6/1973 | Kowalski | 252/186 |
| 3,746,646 | 7/1973 | Boixader | 252/186 |
| 3,792,903 | 2/1974 | Rhoades | 423/17 |
| 3,795,625 | 3/1974 | Kowalski | 252/186 |
| 3,865,435 | 2/1975 | Sareen et al. | 299/5 |
| 4,103,963 | 8/1978 | Espenscheid et al. | 299/4 |
| 4,155,982 | 5/1979 | Hunkin et al. | 423/17 |

*Primary Examiner*—Edward A. Miller

[57] ABSTRACT

In a process for the solution mining of a uranium ore formation using an aqueous alkaline carbonate leaching solution containing hydrogen peroxide as oxidant, the solution is passed through the ore formation in the presence of an alkylidene-1,1-diphosphonic acid. Such an acid has been found to be unique in its capability for stabilizing the peroxide against decomposition in the presence of the uranium ore.

4 Claims, No Drawings

PROCESS FOR SOLUTION MINING OF URANIUM ORES

CROSS-REFERENCE TO RELATED APPLICATION

This application is a continuation-in-part application of copending application Ser. No. 739,968, filed Nov. 8, 1976, now abandoned.

DESCRIPTION

1. Technical Field

The present invention relates to processes for the solution mining of uranium ores and more particularly to such processes which stabilize hydrogen peroxide contained in leaching solutions for this application.

2. Background Art

With the increasing use of nuclear power plants for the production of electricity in the United States, uranium ore deposits have become an increasingly valuable natural resource. Even though there are extensive uranium deposits distributed throughout the Western United States, many of these are located at too great a depth from the surface and/or are of too low concentration to be mined economically by conventional open pit or shaft mining techniques. Especially for such ore sources where conventional mining techniques are uneconomical or where they present severe ecological or esthetic problems, solution mining has been proposed in many instances.

In a typical solution mining situation, a central production well can be drilled into a permeable uranium ore formation and a plurality of regularly spaced injection wells drilled around the production well. To start production, a leaching solution is pumped into the ore formation through the injection wells. The solution moves through the formation dissolving the uranium compounds in the ore as it passes toward the center of the ore formation from which it is removed by means of the production well. The leaching solution containing the dissolved uranium is then pumped to an extraction treatment zone where the leaching solution is treated to separate the uranium compounds.

After being recharged with any components which may have become depleted, the leaching solution can then be recycled through the formation.

Several solution mining (in situ-leaching) processes have been suggested. For example, the solvents most frequently used for leaching have been aqueous acid or carbonate solutions. The uranium can then be removed from the leaching solution by ways such as (1) adjusting the pH of the solution to neutral or basic pH to precipitate out the uranium, (2) separating the uranium compounds by ion exchange or (3) concentrating the uranium by liquid-liquid extraction.

Many in-situ leaching operations employ an alkaline carbonate leaching solution containing an oxidizing agent. The carbonate can be present as an ammonium or sodium salt or mixtures thereof. Ammonium ions are preferred in many cases because they are less likely to interfere with permeability of the ore formation.

Because uranium in the 4+ valence state is insoluble in water, an oxidant is needed to oxidize it to the 6+ valence state which is soluble in the form of a carbonate complex. The basic chemistry of this method of extraction is shown by the following equations:

$$UO_2+\tfrac{1}{2}O_2\rightarrow UO_3 \quad (1)$$

$$UO_3+H_2O+3CO_3^{--}\rightarrow UO_2(CO_3)_3^{4-}+2OH^{31} \quad (2)$$

The hydroxyl ions produced in reaction (2) tend to cause formation of insoluble uranium compounds, especially when sodium ions are also present. The —OH ions can, however, be readily removed by reaction with bicarbonate ions which favorably affect the equilibrium of the solubilizing reaction as well as prevent precipitation of insoluble uranium compounds such as sodium uranate. Thus, it is usually preferred to use carbonate leaching solutions containing enough bicarbonate to react with hydroxyl ions formed in the manner of reaction (2).

Though many oxidizing agents have been suggested and tried for this use, hydrogen peroxide and molecular oxygen ($O_2$) are especially desirable for this use because they and their decomposition products—$O_2$ and $H_2O$—are completely non-polluting and thus ecologically acceptable. Hydrogen peroxide is preferred, however, because it can be introduced as a liquid that contains oxidant in highly concentrated form, whereas the concentration of injected oxygen gas is highly limited by its solubility. As a consequence, the liquid oxidant is less likely than a gas to cause vapor locking within the ore body. Even when the hydrogen peroxide does decompose in contact with the ore, the $O_2$ produced is likely to be well distributed over a wider portion of the ore body in the form of quite small sized bubbles which further contribute to an even more thorough distribution of oxygen solubilized in leach solution. Thus, there is greater potential for increasing the reaction rates for solubilizing the insoluble uranium compounds in the ore.

The chemistry of uranium leaching is less well characterized for hydrogen peroxide than for oxygen. Conceivably, by analogy with equation (1) above, the reaction may be:

$$UO_2+H_2O_2\rightarrow UO_2^{++}+2OH^-$$

However, uranium in the 6+ valence state is known to form peroxy addition compounds such as $UO_6^{=}$, and it is entirely likely that one or more peroxy compounds are involved in the overall chemistry. Suffice it to say, however, that $H_2O_2$ is a potential oxidant either as $H_2O_2$ or as a latent source of $O_2$. If, however, $H_2O_2$ decomposition catalysts in the ore cause too rapid a decomposition of the $H_2O_2$, vapor locking could conceivably occur. Thus, some degree of $H_2O_2$ stabilization would be helpful. Furthermore, $H_2O_2$ is as a general rule a stronger oxidizing agent than $O_2$, and the longer the $H_2O_2$ can remain undecomposed, the more $UO_2$ it will come in contact with.

Many types of stabilizers have been proposed as inhibitors for the decomposition of $H_2O_2$. For example, Blazer et al, U.S. Pat. No. 3,122,417, disclose alkylidene diphosphonic acids as stabilizers for hydrogen peroxide solutions which are acidic or basic. In U.S. Pat. No. 3,387,939 to Reilly et al there are disclosed stannate stabilizer compositions containing an alkylidene diphosphonic acid and acidic hydrogen peroxide solutions stabilized therewith. The presence of the alkylidene diphosphonic acid prevents the precipitation of the stannate by polyvalent cations such as aluminum and calcium. Carnine et al, U.S. Pat. No. 3,383,174, disclose the use of a nitrilo trimethylene phosphonic compound in stannate-stabilized peroxide solutions to preclude the preipitation of stannate by polyvalent cations.

Reilly, U.S. Pat. No. 3,687,627 discloses acidic stabilized hydrogen peroxide solutions containing a soluble stannate stabilizer, a soluble magnesium salt, an alkylidene diphosphonic acid or a soluble salt thereof and optionally a soluble pyrophosphate or fluosilicate.

In U.S. Pat. No. 3,649,194 to Glanville there is disclosed the use of an organic hydroxy compound as stabilizer for acidified hydrogen peroxide solutions containing metal ions, particularly peroxide solutions useful for pickling copper. Useful organic hydroxy compounds disclosed therein are phenol, paramethoxyphenol, allyl alcohol, crotyl alcohol, and cis-1,4-but-2-ene-diol.

U.S. Pat. No. 3,701,825 to Radimer et al is directed to the use of a water-soluble ethylenediamine tetra(methylenephosphonic acid) compound to stabilize aqueous hydrogen peroxide solutions over a pH range of at least 1.5 to 13.5 against decomposition by contaminants such as cations of iron, copper and manganese.

With the exception of the Glanville patent, most of the prior art is directed to suppression of the wasteful decomposition of hydrogen peroxide under storage or shipping conditions or upon dilution at the user's site.

Other well-known stabilizers for $H_2O_2$ include citric acid, tartaric acid, sorbitol, nitrilo triacetic acid (NTA), ethylenediaminetetraacetic acid (EDTA), dipicolinic acid and 2-hydroxyacetic acid.

Notwithstanding the rather great number of stabilizers for hydrogen peroxide solutions at various pH levels and with various ions dissolved therein, it has been found that many of these are relatively ineffective as decomposition inhibitors when they are used to stabilize $H_2O_2$ during leaching operations with alkaline carbonate leaching solutions.

According to the present invention there is provided in a process for the solution mining of a uranium ore formation where an aqueous alkaline carbonate leaching solution having a pH of 7–10 and containing hydrogen peroxide as oxidant is passed through the ore formation to dissolve uranium from the formation therein and the solution is withdrawn from the ore formation enriched in uranium, the improvement comprising: passing the leaching solution through the ore formation in the presence of an alkylidene-1,1-diphosphonic acid having the structural formula:

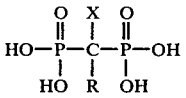

where

X is —OH or —H, and

R is an alkyl group of 1 to 5 carbon atoms.

DISCLOSURE OF THE INVENTION

The compositions useful in carrying out the process of the invention are aqueous alkaline carbonate solutions which contain hydrogen peroxide as an oxidant. By "alkaline carbonate" is meant either alkali metal or ammonium carbonates. Within the context of the invention such alkaline carbonates refer to either $=CO_3$ or $—HCO_3$. In both instances, the leaching solution can contain mixtures of alkali metal and ammonium ions as well as mixtures of the two carbonate forms. Such solutions will ordinarily have an initial pH, i.e., prior to injection into the ore formation, of 7–10.

Although the alkali metal or ammonium carbonate concentration may vary widely within those pH limits, the leaching solution will ordinarily contain from 0.5 to 20 grams per liter of carbonates, basis either $=CO_3$ and/or $—HCO_3$. From 1 to 10 grams per liter are preferred. In the case of ammonium carbonates, such solutions are prepared most easily by sparging $NH_3$ and $CO_2$ into water until the desired concentrations of reactants are reached and then adjusting the pH by the addition of more $NH_3$ to raise the pH or $CO_2$ to lower pH. For either the ammonium or alkali metal carbonates, they can, however, be made by dissolving the solid carbonates in the water and then adjusting pH in the same manner or altering the proportions of the solid carbonates. Typically, an ammonium or alkali metal carbonate leaching solution will contain from about 10 to 15 grams of carbonate compounds per liter of solution, e.g., 10 grams of bicarbonate and 0–5 grams of carbonate. The preferred alkaline carbonate is ammonium carbonate. Of the alkali metal carbonates, sodium carbonate is preferred.

The concentration of hydrogen peroxide in the leaching solution is only one of the factors which bears upon the successful solution mining of uranium ores. Other economic or technical parameters associated with the particular formation being treated, such as pH, particle size and temperature, may be more important and may even be overriding considerations. Ordinarily, however, the aqueous leaching solution will contain 0.1–10 grams $H_2O_2$ per liter and preferably 0.2–5 grams $H_2O_2$ per liter.

Hydrogen peroxide suitable for use in leaching solutions used in the invention is available commercially in aqueous solutions containing from 10 to 90% by weight $H_2O_2$, any of which can be used. As used in accordance with the invention, hydrogen peroxide has very little effect on pH of the leaching solution and therefore need not ordinarily be a factor in adjusting pH of the leaching solution.

The alkylidene diphosphonic acids which are useful in the invention are those corresponding to the structural formula:

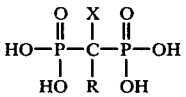

where

X is selected from the group consisting of hydrogen and hydroxyl and

R is a $C_{1-5}$ alkyl group.

Alkali metal or ammonium salts of these acids are also suitable; and, as used herein, the term "alkylidene diphosphonic acid" is intended to include both partial and complete salts of such acids. Compounds of the above structure in which X is hydroxyl and R is $C_{1-2}$ alkyl are preferred. The compound 1-hydroxyethylidene-1,1-diphosphonic acid is preferred because of its availability in commercial quantities.

The amount of alkylidene phosphonic acid used is quite subjective and depends upon a number of factors. For example, both the stability of the $H_2O_2$ and effectiveness of the diphosphonic acid are affected by the particular physical and chemical characteristics of the formation being treated. Thus, as little as about 1 ppm and preferably about 5 ppm by weight diphosphonic acid may be sufficient, but from about 10 to 200 ppm being especially preferred. By and large, higher concentrations of diphosphonic acid give greater stability, but above about 500 ppm, the marginal stability obtained is likely to be too small to warrant the additional amount of diphosphonic acid. Such variations are, however, well within the skill of the art and are easily determined by routine experimentation for each leaching operation.

There are two methods by which the diphosphonic acid can be added to the leaching solution: (1) by incorporation into the $H_2O_2$ solution, and (2) by adding it separately to the leaching solution. The latter procedure has the advantage of greater flexibility since the diphosphonic acid is added only as needed. On the other hand, when the diphosphonic acid is added via the peroxide solution, it may be necessary for economic reasons to start off with a leaching solution in which the $H_2O_2$ is only very lightly stabilized in order to slow the rate of diphosphonic acid build-up in the solution as additional stabilized $H_2O_2$ is added to the leaching solution after each leaching cycle.

Various co-stabilizing materials can be used in admixture with the alkylidene phosphonic acids, for example, those which are mentioned in the Background Art hereinabove. However, no unusual further advantage for such mixtures has yet been observed.

In copending U.S. patent application Ser. No. 739,967, filed Nov. 8, 1976, the inclusion of a small amount of alkali metal silicate in ammonium carbonate leaching solutions containing $H_2O_2$ as oxidant is disclosed to be useful to reduce the tendency of the formation being treated to become less permeable. Consequently, it is foreseen that the leaching solutions useful in this invention may also contain alkali metal silicates dissolved therein when the primary leaching agent is ammonium carbonate (including bicarbonate).

It has been found in such instances that only a very small concentration of alkali metal silicate per liter of total leaching solution is needed to improve permeability of the formation significantly. The minimum effective concentration of silicate is highly subjective to the formation being treated and its particular physical and chemical characteristics. However, ordinarily at least about 0.1 and preferably at least 0.2 gram of alkali metal silicate will be used per liter of total leaching solution. However, more significant effects are produced if at least about 0.5 gram per liter is used. An optimum concentration of alkali metal silicate appears to be 0.5–1.5 gram per liter. Even though higher concentrations of alkali metal silicate (e.g., up to 5 g/l) may be used, no further advantage with respect to permeability was apparent from such use. Furthermore, the use of higher concentrations in some instances will significantly increase the incidence of gelling the silicate which will cause a further loss in permeability of the ore formation. Nevertheless, it has been found that leaching solutions containing as high as 10 grams of $NH_3$ and $CO_2$ per liter and even higher along with the preferred 0.5–1.5 grams of silicate per liter resists gellation for quite long periods of time.

Suitable alkali metal silicates include silicates of sodium, potassium and lithium, of which sodium is preferred. The silicates must, however, be stable aqueous solutions which contain no appreciable amount of particulate silica. Transparent solutions which exhibit little, if any, Tyndall effect, are uniformly suitable with respect to stability against loss of permeability induced by gellation. Suitable aqueous sodium silicate solutions are available having $SiO_2$:$Na_2O$ weight ratios of from 1.90 to 3.25, containing from 27.0 to 36.0% wt $SiO_2$ and from 8.7 to 19.4% wt $Na_2O$. Sodium silicate solutions of this type are alkaline and have a pH range of between 10 and 13. The addition of sodium silicate in these amounts has only a small effect in elevating pH of the leaching solution.

In preparing leaching solutions for use in the process of the invention, no particular order of mixing is needed.

The invention is exemplified and can readily be understood by reference to the examples which are set out hereinbelow.

DEFINITIONS AND ABBREVIATIONS

The term "carbonate" unless otherwise limited is used to refer broadly to leach solutions containing carbonate, bicarbonate or mixtures thereof.

"Leach" refers to the solution fed from the inlet reservoir to the top of the leach column.

"Leachate" refers to the solution pumped from the bottom of a leach column after passing through the ore bed.

The terms "silicate", "sodium silicate", "sil.", and "$NaSiO_3$" may be used interchangeably. All weights or concentrations are on the basis of Du Pont sodium silicate, Grade F or Grade No. 9 diluted to the same solids content as Grade F. Both Grades have an SiO:$Na_2O$ weight ratio of 3.25.

EXPERIMENTAL APPARATUS AND PROCEDURE

1. Column Leaching Apparatus

Two parallel leaching systems were set up, each having (1) an inlet reservoir for fresh leaching solution, (2) a leach solution feed pump on the outlet of the inlet reservoir communicating with (3) a leaching column containing a fixed bed of finely divided uranium ore having a depth of about 2.5–10 cm, (4) a leachate pump on the outlet of the leach column discharging into (5) a leachate reservoir. The vapor space in the tops of the leach columns, the leachate reservoir and inlet reservoir were each manifolded to a gas collection burette so that any $O_2$ gas release in the system could be measured.

2. Procedures

A. Static Decomposition Test

To 5.0 g of ore in a 125 ml Erlenmeyer flask, outfitted with one-hole glass stopper, was added 25 or 50 cc of leach and either 1.8 or 2.0 cc of a hydrogen peroxide solution containing 50% $H_2O_2$, to provide 1.08 or 1.20 g $H_2O_2$/flask. As soon as the peroxide was added, the flask was stoppered, swirled for a few seconds to mix and then allowed to stand without further agitation as the released gas was collected via appropriate tubing in an inverted graduate cylinder filled with water.

The percent of $H_2O_2$ decomposed after a particular running time (t) was approximated by the following computation:

$$\frac{\text{Vol. of } O_2 \text{ collected at time } t}{\text{Total vol. of } O_2 \text{ released}} \times 100 = \%\ H_2O_2 \text{ decomposed at time } t$$

At ambient temperature the observed volumes of gas released corresponded to about 11% over theory at standard temperature and pressure (STP). Therefore, to convert observed $O_2$ volume to approximate STP volume, multiply by 0.9.

B. Column Leaching Procedure (1) Pack leach columns with ore charge resting atop glass wool plug on a coarse fritted glass disk. Tamping was generally not required to prevent voids;

(2) Charge inlet reservoirs with one liter of leaching solution with ingredients being added in the following order: $NH_4HCO_3$ and/or $(NH_4)_2CO_3$, sodium silicate solution (if used) and $H_2O_2$ solution;

(3) Pump leaching solution into leach columns to permeate to bottom of ore bed and continue pumping rate;

(4) Activate leachate pump and establish as nearly as possible a predetermined leach flow through both systems.

3. Ore Characteristics

The uranium ore used was a weakly mineralized ore of sandy consistency containing only about 0.03% wt U rich in pyrite from South Texas. The ore was sufficiently wet (12.2% wt $H_2O$) so that it did not flow freely, but was easily spooned into the leach column.

CONTROL EXAMPLE

Using the Static Decompositon Test procedure described above, the amount of decomposition of $H_2O_2$ in aqueous ammonium bicarbonate leach solution in contact with uranium ore was determined after 60 minutes, using leach solutions containing from 2.25 to 15 g/l $NH_4HCO_3$ and no stabilizers. The tests were run using 5.0 g of 10 mesh (U.S. Standard) ore in 50 cc of leaching solution at 30° C. The results are given in Table 1, which follows:

TABLE 1

EFFECT OF SALT CONCENTRATION OF LEACHING SOLUTION ON STABILITY OF $H_2O_2$ WITHOUT STABILIZER

| $NH_4HCO_3$ Conc. (g/l) | 2.25 | 5.0 | 7.5 | 10 | 15 |
|---|---|---|---|---|---|
| Vol. of $O_2$ Collected (cc) | 60 | 127 | 163 | 196 | 239 |

These data show that the salt content of the leaching solution contributes to the instability of the $H_2O_2$ contained therein. The range of $NH_4HCO_3$ concentration used in this test corresponds to the concentrations which are expected to be used in commercial scale solution mining of uranium ores.

EXAMPLE I

In this example, the effectiveness of 1-hydroxy-1,1-ethylidene diphosphonic acid (HEDP) by itself to stabilize $H_2O_2$ in the presence of uranium ore was compared to a number of other well known peroxide stabilizers and admixtures with HEDP. In each of the following summarized tests, the leach solution (25 cc per flask) was comprised of 8 g/l of ammonium bicarbonate, 2 g/l of ammonium carbonate and 1.20 g/l of $H_2O_2$ and had a pH of 8.2. Using the Static Decomposition Test procedure of Example I, the results were as follows:

TABLE 2

| Inhibitor Composition | Amount Added (mg/l) | % $H_2O_2$ Decomposed After 90 min |
|---|---|---|
| — | None | 77 |
| HEDP | 120 | 23 |
| Tartaric Acid | 200 | 88 |
| HEDP/Tartaric Acid | 120/200 | 12 |
| Sorbitol | 200 | 82 |
| HEDP/Sorbitol | 120/200 | 16 |
| NTA Disodium Salt | 200 | 89 |
| HEDP/NTA Disodium Salt | 120/200 | 15 |
| EDTA | 200 | 84 |
| HEDP/EDTA | 120/200 | 15 |

The above data show that all of the above $H_2O_2$ stabilizers augmented the effectiveness of HEDP to stabilize the $H_2O_2$. However, each one by itself, i.e., without HEDP, was essentially ineffective.

EXAMPLE II

A further series of tests was conducted by the same procedure as Example I to observe the interaction between HEDP and tartaric acid at other concentrations of each.

TABLE 3

| Inhibitor Composition | Amount Added (mg/l) | % $H_2O_2$ Decomposed After 90 min |
|---|---|---|
| — | None | 67 |
| HEDP | 120 | 23 |
| Tartaric Acid | 300 | 60 |
| HEDP/Tartaric Acid | 60/150 | 27 |
| HEDP/Tartaric Acid | 120/240 | 15 |

The data in Table 3 show again that HEDP can be used effectively in combination with other stabilizing agents.

EXAMPLE III

In this Example, as in Example I, the effectiveness of HEDP to stabilize $H_2O_2$ in the presence of uranium ore by itself was compared to admixtures of HEDP with a number of other well known peroxide stabilizers, including two which were studied in Example I. The leach solution was comprised of 8 g/l of ammonium bicarbonate and 2 g/l of ammonium carbonate and had a pH of 8.2. Using the same procedure as in Example I, the results were as follows:

TABLE 4

| Inhibitor Composition | Amount Added (mg/l) | % $H_2O_2$ Decomposed After 90 min |
|---|---|---|
| HEDP | 120 | 22 |
| HEDP/Citric Acid | 120/200 | 22 |
| HEDP/Tartaric Acid | 120/200 | 27 |
| HEDP/Dipicolinic Acid | 120/200 | 17 |
| HEDP/Sodium Glycolate | 120/200 | 26 |

In this series of tests, only the dipicolinic acid augmented the stabilizing action of the HEDP. However, none of the other stabilizers exhibited any significant antagonistic effect on the HEDP.

EXAMPLE IV

In the same manner as Example I, HEDP and a number of other known stabilizers were tested as to their effectiveness to stabilize the $H_2O_2$ in a carbonate leaching solution against decomposition in the presence of uranium ore. In each of the tests, the leaching solution was comprised of 4 g/l each ammonium bicarbonate and ammonium carbonate and had a pH of 8.4.

TABLE 5

| Inhibition Composition | Amount Added (mg/l) | % $H_2O_2$ Decomposed after 90 Min |
|---|---|---|
| — | — | 61 |
| HEDP | 120 | 23 |
| aminotri(methylphosphonate) | 118 | 34 |
| HEDP/β-hydroxy quinoline | 120/106 | 20 |
| HEDP/hydroxyacetic acid/ dipicolinic acid | 120/200/200 | 15 |
| HEDP | 240 | 14 |
| aminotri(methyl phosphonate) | 235 | 30 |

These data show that only HEDP and the aminotri(-phosphonate) had any substantial inhibiting action, but the latter was not nearly so effective as the HEDP. The β-hydroxy quinoline and the hydroxyacetic acid/-dipicolinic acid mixtures only marginally improved the inhibiting action of the HEDP despite the use of substantial concentrations.

EXAMPLE V

A further series of Static Decomposition Tests was run to observe the effectiveness of HEDP in carbonate leaching solutions containing alkali metal silicate. The leaching solution contained 4 g/l each of ammonium bicarbonate and ammonium carbonate and had a pH of 8.4.

TABLE 6

| Inhibitor Composition | Amount Added (mg/l) | % $H_2O_2$ Decomposed After 90 min |
|---|---|---|
| — | — | 63 |
| HEDP | 120 | 22 |
| Sodium silicate | 2,000 | 59 |
| HEDP/Sodium silicate | 120/2,000 | 19 |

These data show that HEDP is equally effective in the presence of alkali metal silicates and thus can be used in leaching solutions containing alkali metal silicates which have been added to reduce permeability loss.

EXAMPLE VI

In the previous examples, the leaching solutions used ammonium carbonate as the alkaline carbonate component. In this example, it can be seen that leaching solutions using alkali metal carbonates as exemplified by sodium carbonate are also useful in the process of the invention.

In each of these tests the leaching solution (50 cc per flask) contained 8 g/l of sodium bicarbonate and 2 g/l of sodium carbonate and had a pH of 9.15. Using the same procedure as in the Control Example, the results were as follows:

TABLE 7

| Inhibitor Composition | Amount Added (mg/l) | % $H_2O_2$ Decomposed after 90 Min |
|---|---|---|
| — | — | 56 |
| HEDP | 120 | 9.2 |
| HEDP | 12 | 33 |
| Aminotri(methylphosphonate) | 118 | 38 |
| Aminotri(methylphosphonate) | 197 | 28 |

The unique superiority of HEDP is clearly shown herein by the fact that only 12 ppm of HEDP were more effective than 118 ppm of aminotri(methylphosphonate) and interpolation of the data indicates that it would take 150 ppm of the aminotri(methylphosphonate) to equal the stabilizing ability of only 12 ppm of HEDP.

We claim:

1. In a process for the solution mining of a uranium ore formation where an aqueous alkaline carbonate leaching solution having a pH of 7–10 and containing hydrogen peroxide as oxidant is passed through the ore formation to dissolve uranium from the formation therein and the solution is withdrawn from the ore formation enriched in uranium, the improvement comprising: passing the leaching solution through the ore formation, said leaching solution containing an alkylidene-1,1-diphosphonic acid having the structural formula:

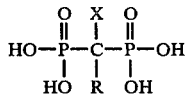

where

X is —OH or —H, and

R is an alkyl group of 1 to 5 carbon atoms wherein the diphosphonic acid is present at a concentration of at least 1 part per million by weight based on the weight of the leaching solution to stabilize the hydrogen peroxide.

2. The process of claim 1 wherein X is —OH and R is methyl.

3. The process of claim 2 wherein the diphosphonic acid concentration is in the range of 5–500 parts per million by weight.

4. The process of claim 3 wherein the alkaline carbonate leaching solution is an ammonium carbonate leaching solution.

* * * * *